United States Patent [19]

Jiménez-Maldonado

[11] Patent Number: 4,846,717

[45] Date of Patent: Jul. 11, 1989

[54] CONTINUOUS METHOD AND APPARATUS FOR THE THERMAL TREATMENT OF METALLIC WORKPIECES

[75] Inventor: Gilberto-Alejandro Jiménez-Maldonado, Residencial Chipinque, Mexico

[73] Assignee: American Wheels De Mexico, S.A.D. E C.V., Guadalupe, Mexico

[21] Appl. No.: 175,197

[22] Filed: Mar. 30, 1988

[51] Int. Cl.[4] ..... F27B 9/02; F27D 15/02

[52] U.S. Cl. ..... 432/128; 432/163; 432/77; 432/85; 432/8

[58] Field of Search ..... 432/2, 5, 8, 9, 128, 432/135–137, 141, 153, 163, 171, 77, 85

[56] References Cited

U.S. PATENT DOCUMENTS

| | | | |
|---|---|---|---|
| 2,713,480 | 7/1955 | Ruckstahl | 432/128 |
| 3,778,221 | 12/1973 | Bloom | 432/128 |
| 3,850,318 | 11/1974 | Wentworth | 432/128 |
| 3,982,887 | 9/1976 | Kendziora et al. | 432/128 |
| 3,982,888 | 9/1976 | Moussou et al. | 432/128 |
| 4,047,886 | 9/1977 | Heyrand | 432/128 |
| 4,510,363 | 4/1985 | Reynolds, Jr. | 432/163 |

*Primary Examiner*—Henry C. Yuen

*Attorney, Agent, or Firm*—Abelman, Frayne, Rezac & Schwab

[57] ABSTRACT

Continuous thermal treatment for the strengthening of metallic workpieces is carried out by placing a batch of at least two workpieces on a basket hinged on a continuously advancing conveyor chain; introducing said workpieces in said basket through a first instantaneously opening and closing gate into a uniformly heated first thermal treating step wherein the continuously advancing workpieces are heated at a temperature of about 560° C.; introducing the heated workpieces in said basket through a second instantaneously opening and closing gate into a second thermal treatment step placed immediately after the end of the first step and in communication therewith, by lifting a vat containing a cooling fluid to immerse said workpieces in said basket into the cooling fluid of said vat to rapidly cooling said workpieces to a temperature of about 100° C. and thereafter lowering said vat.

22 Claims, 2 Drawing Sheets

CONTINUOUS METHOD AND APPARATUS FOR THE THERMAL TREATMENT OF METALLIC WORKPIECES

BACKGROUND OF THE INVENTION

A. Field of the Invention.

The present invention is related with the thermal treating of metallic workpieces and more specifically to a method and an apparatus for the strengthening of aluminum workpieces including aluminum wheel rims for vehicles, by means of a continuous thermal treatment.

B. Description of the Previous Art.

Strengthening of metallic workpieces such as aluminum wheel rims, piston head and cylinder assemblies, etc., are conventionally carried out by subjecting said wheel rims to a first thermal treating step at an elevated temperature of about 550° C., then to a quenching step wherein the temperature is drastically reduced at about 150° C. into a cooling fluid chamber, in a less possible time, and then subjecting the cooled wheel rims to a third heating temperature at about 150° C. and diminishing uniformly the temperature to a room temperature.

The conventional process for the thermal treatment of wheel rims comprises placing a batch of 300 to 500 wheel rims on a platform of a furnace wherein said wheel rims are maintained to a temperature of about 563° C. for eight hours; immersing said wheel rims into a cooling chamber by let them fall by gravity into said chamber containing a saline cooling solution, placed under said furnace in order to suddenly cool said wheel rims to a temperature of about 100° C.; then, placing again said wheel rims on the platform to the same furnace in order to reheat again said wheel rims to a temperature of about 150° C. for two hours; and finally recovering said wheel rims by placing the platform at room temperature.

This conventional process has the drawback that it is an energy consuming process. Heat looses are presented each time that the furnace is opened, i.e., firstly on introducing the batch into the furnace, then on immersing said wheel rims into the cooling chamber and finally on opening the furnace to recover said wheel rims, and consequently of the above, great amounts of energy are also necessary in the first and third steps so as to allow said furnace to reach treatment temperatures and maintaining them in equilibrium.

Furthermore, it is a time consuming process because again, each time that the furnace is opened both in the same cycle as well as in each new cycle of treatment, it is necessary to wait a long time to let the furnace to reach the thermal treatment temperatures and the thermal equilibrium.

It is true that the third thermal step, as well as any further steps, such as washing and coating, although necessary, is not a critical one and therefore the energy looses therein could be diminished by carrying it out in a separate stage, however, as to the time and additional equipment is concerned, it is desirable to carrying it out in the same process stage.

Furthermore, in said process when one or more wheel rims of a batch result defective, the entire batch of 300 to 500 wheel rims has to be rejected, with the consequent looses of time, energy, raw materials and money.

Another important drawback of the conventional process is the contamination of the furnace with the oxidant atmosphere and vapors provided by the quenching chamber, causing problems to the process and to the workpieces.

One of the most relevant advances in the art to overcome the problems of the conventional processes and apparatuses is represented by the invention disclosed in U.S. Pat. No. 3,447,788 by providing a quenching chamber separated and independent of a loading chamber and the furnace so as to prevent the oxidant and contaminant vapors to enter into the furnace and wherein the workpieces are firstly charged on a loading chamber which afterwards is shifted to a sealed closed heating chamber, then shifted back to the loading chamber and finally transferred to the quenching chamber.

Although said process and apparatus avoid problems of contamination of the heating chamber, still have problems of energy and time consumption because the heating steps are carried out in the same heating chamber which have to reach their equilibrium temperature in each step and are not continuous. There are continuous processes for the annealing and coating of metallic workpieces, but such processes are limited only to continuous and flexible metal strips or wire, as disclosed in U.S. Pat. Nos. 3,511,686 and 4,295,033.

All the above disclosed drawbacks of the processes and apparatuses of the previous art are overcomed by the continuous process and apparatus for the thermal treatment of metallic workpieces, of the present invention, comprising placing a batch of two or four workpieces on carrier means such as a basket hinged on a continuously advancing conveyor means such as a conveyor chain; introducing said workpieces in said basket through a first instantaneously opening and closing gate into a uniformly heated first thermal treating step wherein said continuously advancing workpieces are heated at a temperature of from about 500° C. to about 600° C. and preferably 560° C.; introducing the heated workpieces in said basket through a second instantaneously opening and closing gate into a second thermal treatment step placed immediately after the end of the first step and in communication therewith, by lifting a vat containing a cooling fluid to immerse said workpieces in said basket into the cooled fluid of said vat in order to rapidly cooling said workpieces to a temperature of from about 50° C. to about 150° C. and preferably of about 100° C. and then lowering said vat; and optionally introducing said cooled workpieces in said basket through a third instantaneously opening and closing gate into a third thermal treatment step placed immediately after the end of the second step and in communication therewith, wherein said continuously advancing workpieces in said basket are heated to a temperature of from 150° C. to about 250° C. and preferably of about 200° C.

In this way, by having the two or three thermal treating steps isolated from each other but placed in communication one immediately after the other, and by providing a cooling vat which is easily lifted and lowered so as to allow the hingeable baskets with the metallic workpieces to be immersed into said vat, and by providing the instantaneously opening and closing gates between each step, contamination with the oxidizing vapors of the cooling chamber, to the thermal treatment steps is avoided.

Furthermore, by providing the thermal treatment steps placed one immediately after the other and by having them isolated from each other by means of their respective instantaneously opening and closing gates, the thermal treating time is reduced from eight hours in the first step of the conventional process and apparatus, to only five hours in accordance with the present invention, with the consequent reduction in the overall time.

Obviously, it has to be understood that the critical steps of the thermal treatment comprise only the heating and quenching steps and that the third thermal step can be optionally carried out in a separate stage, however, as already disclosed, it is a matter of convenience that this third step, as well as washing and coating steps, be carried out in the way previously disclosed to optimize energy, time and money savings.

Additionally, by continuously providing batches of at least two or four workpieces to the thermal process and apparatus, rejection of large batches of workpieces is avoided.

SUMMARY OF THE INVENTION

It is therefor as main object of the present invention, to provide a continuous process and apparatus for the thermal treatment of metallic workpieces such as aluminum wheel rims, wherein each thermal treatment step is placed immediately after the other and in communication therewith.

It is also a main object of the present invention, to provide a continuous process and apparatus of the above disclosed nature, in which a considerable reduction of treatment time is achieved by having the thermal treatment steps placed one immediately after the other, in communication but isolated from each other.

It is also a main object of the present invention, to provide a continuous process and apparatus of the above disclosed nature, in which batches of at least two workpieces are continuously fed to the thermal treatment process and apparatus, so as when a batch results with defective pieces, the rejected batch is of just few pieces.

It is another main object of the present invention, to provide a continuous process and apparatus of the above disclosed nature, in which all the thermal treatment steps are continuous.

It is a further main object of the present invention, to provide a continuous process and apparatus of the above disclosed nature, in which the residence time in each respective thermal treatment step is compensated by means of the length of the respective step.

It is also a main object of the present invention, to provide a continuous apparatus for the thermal treatment of metallic workpieces such as aluminum wheel rims, in which batches of at least two workpieces are continuously transported by means of baskets hinged on a continuously advancing conveyor chain throughout the apparatus.

It is also a main object of the present invention, to provide a continuous apparatus of the above disclosed nature, comprising two thermal treatment chambers placed each one immediately after the other and each comprising an instantaneously opening and closing gate for the access of the batches of workpieces in said hingeable baskets.

It is also a main object of the present invention, to provide a continuous apparatus of the above disclosed nature, wherein a third thermal treatment step is also placed immediately after the second thermal treatment step and in communication therewith, so as to save energy and time.

It is also a main object of the present invention, to provide a continuous apparatus of the above disclosed nature, comprising a cooling fluid container which is able to be lifted and lowered instantaneously up to the hingeable baskets containing the workpieces, in order to rapidly cooling the same.

These and other objects and advantages of the method and apparatus of the present invention will be apparent to those persons skilled in the art, from the teachings of this invention, which will be considered within the scope of the present invention as claimed in the appended claims.

DESCRIPTION OF THE DRAWINGS

In this specification and the accompanying drawings, applicants have shown and suggested various alternatives and modifications to the present invention, but it is to be understood that these are not intended to be exhaustive and that changes and modifications can be made which will be within the scope of this invention. These suggestions herein are selected and included for purposes of illustration in order that other persons skilled in the art might fully understand the invention and the principles thereof and thus could be enabled to modifying and embodying it in a variety of forms, each as may be best suited to the conditions of a particular use.

DETAILED DESCRIPTION OF THE INVENTION

Figure 1:
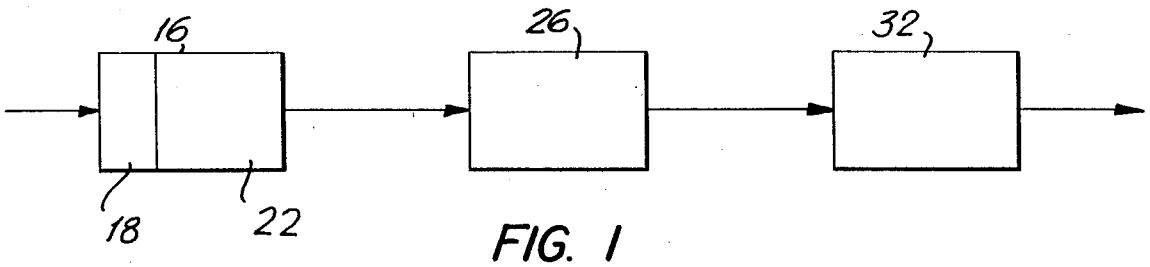
FIG. 1 is a block diagram of a preferred embodiment of the invention.
Figure 2:
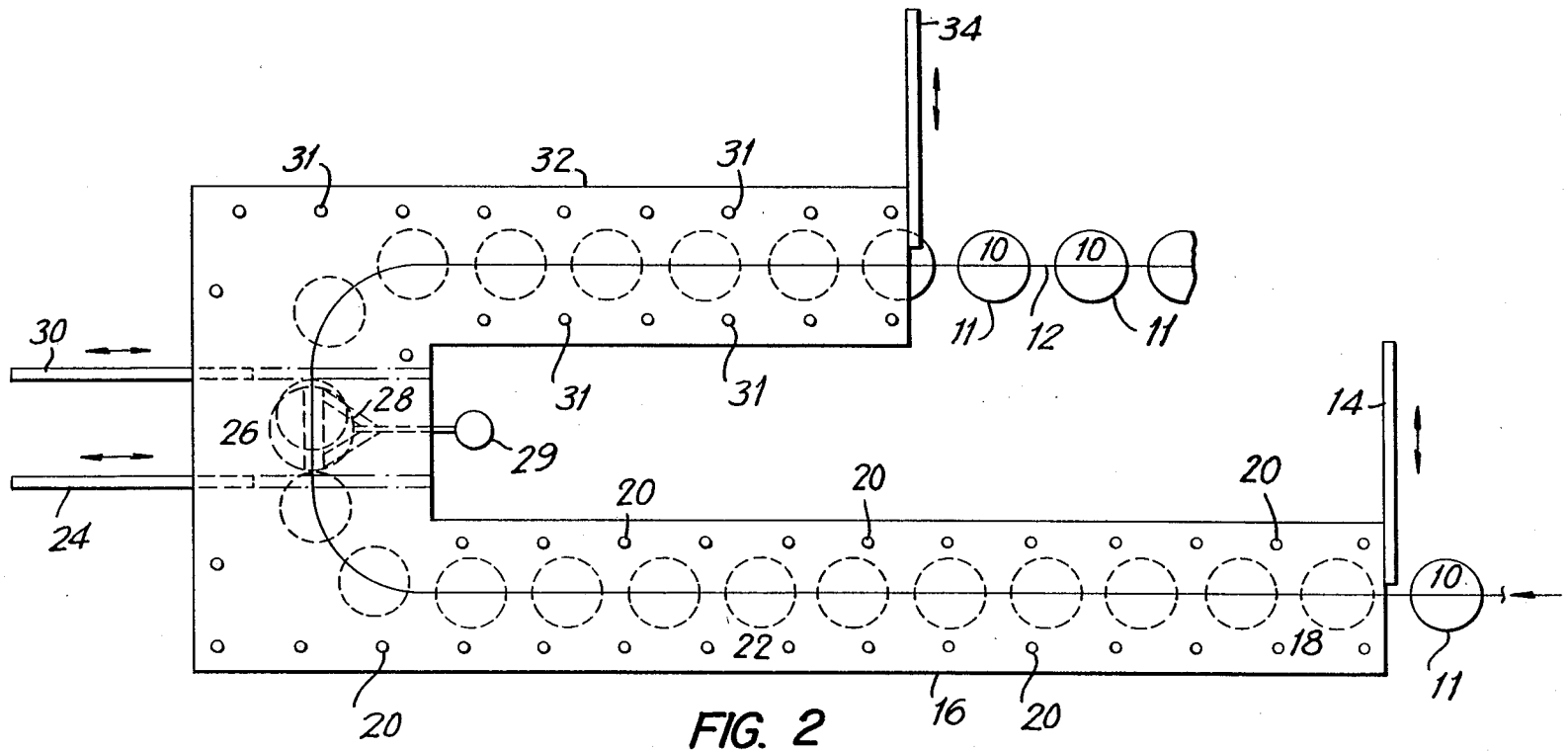
FIG. 2 is a schematic plan view of a treating apparatus of the preferred embodiment thereof.

Referring to FIGS. 1 and 2, of the drawings, wherein same numerals describe same features of the invention, a continuous method and apparatus for the thermal treatment of aluminum wheel rims, in accordance with the present invention, comprising: placing four aluminum wheel rims on carrier means such as a hingeable basket 10 which is continuously moved forward by conveyor means such as a conveying chain 12. Said hingeable basket comprising compartments 11 for said wheel rims. The wheel rims are then passed, by means of a suddenly movement forward in a short time interval, through a first instantaneously opening and closing gate 14 into a first thermal treating chamber 16 comprising an adequeating zone 18 in which the wheel rims are rapidly heated to reach a first thermal treating temperature of about 560° C., following to a uniformly heating zone 22 wherein said wheel rims are maintained at the same temperature. Heating of the wheel rims is carried out by means of infrared heating bars 20 placed vertically on both sides of the first thermal treatment chamber and is maintained for five hours.

Once the wheel rims have reach its first thermal treating temperature they are suddenly passed, at the end of zone 22, through a second instantaneously opening and closing gate 24, to a cooling chamber 26 placed immediately the end of the first chamber 16 and in communication therewith, wherein the wheel rims are subjected to a second thermal treating temperature of about 100° C., by immersing said wheel rims into a vat 28 containing a saline cooling solution (not illustrated), which is lifted and then lowered in order to rapidly cooling said wheel rims. Lifting and lowering movements of the vat 28 are carried out by means of a mechanism 29 driven by a fluid motor.

The cooled wheel rims are thence suddenly passed through a third instantaneously opening and closing gate 30 into a third thermal treating chamber 32 placed immediately after the end of the zone 22 of chamber 26 and in communication therewith wherein said wheel rims are heated for two hours at a temperature of about 200° C. Heating in this chamber is also carried out by means of infrared heating bars 31 distributed in both sides of this chamber.

Finally, the so treated wheel rims are retired from the thermal treating apparatus through an instantaneously opening and closing gate 34 to be further treated, i.e. washing and coating as could be necessary.

As it is previously disclosed, movement of the conveyor chain is carried out continuously at a predetermined rate and only, on reaching to each respective gate, it is suddenly moved forward at a higher rate along a predetermined length to allow the batch to pass through said gates avoiding energy looses. However, it is also possible to move the conveyor chain with intermittent movements, i.e. at spaced time intervals and predetermined lengths.

The thermal treatment chambers 16, 26 and 32, are arranged in the form of a continuous tunnel furnace which can be linear or curved for convenience of space.

What is claimed is:

1. A method for the continuous thermal treatment of metallic workpieces comprising:

placing a batch of workpieces on hinging moving carrier means;

introducing said workpieces on said hinging moving carrier means through first instantaneously opening and closing gate means into a heating chamber;

heating said workpieces in said heating chamber at a first thermal treatment temperature;

afterwards introducing said heated workpieces in said hinging moving carrier means through instantaneously opening and closing gate means into a cooling chamber coupled immediately after the end of the heating chamber and in communication therewith; and, lifting a container containing a cooling fluid in said cooling chamber, so as to immerse said workpieces on said carrier means into said cooling fluid, when said container is in a lifted position, in order to rapidly cool said workpieces to a second thermal treatment temperature.

2. A method according to claim 1, further comprising introducing said cooled workpieces on said moving carrier means through third instantaneously opening and closing gate means into a second heating chamber coupled immediately after the end of the cooling chamber and in communication therewith, and heating said workpieces on said hinging moving carrier means to a third thermal treatment temperature.

3. A method according to claim 1, comprising continuously moving said batch of workpieces on said carrier means through said heating and cooling chambers at a predetermined rate and suddenly moving said batch of workpieces at a higher rate along a predetermined length only on reaching the instantaneously opening and closing gate means.

4. A method according to claim 1, comprising intermittently moving said batch of workpieces on said carrier means through said heating and cooling chambers at a predetermined rate along at a predetermined length.

5. A method according to claim 1, wherein said batch of workpieces comprises at least two workpieces.

6. A method according to claim 1, comprising heating said workpieces at said first thermal treating temperature by rapidly raising the temperature to said first thermal treatment temperature and maintaining said temperature for at least five hours.

7. A method according to claim 1, wherein said first thermal treatment temperature is in the range of about 500° C. to about 600° C.

8. A method according to claim 1, wherein said second thermal treatment temperature is in the range from about 50° C. to about 150° C.

9. A method according to claim 2, wherein said third thermal treatment temperature is in the range from about 150° C. to about 250° C.

10. A method according to claim 2, comprising maintaining said third thermal treatment step for at least two hours.

11. An apparatus for the continuous thermal treatment of metallic workpieces comprising:

a heating chamber; a cooling chamber coupled immediately after said heating chamber and in communication therewith;

moving conveyor means passing through the top of said heating and cooling chambers;

carrier means hinged from said moving conveyor means, from transporting batches of workpieces through said heating and cooling chambers;

said heating chamber comprising heating means to heat said workpieces on said carrier means at a first treatment temperature;

gate means to thermally isolate said heating chamber;

said cooling chamber comprising an open container containing a cooling fluid, and means for lifting said container;

whereby to immerse said workpieces in said carrier means into said cooling fluid of said container when it is in a lifted position, in order to rapidly cool said workpieces to a second treatment temperature; and, gate means to isolate said cooling chamber.

12. The apparatus according to claim 11, comprising a second heating chamber coupled immediately after the cooling chamber and in communication therewith, including heating means to heat said workpieces on said carrier means to a third thermal treatment temperature, and gate means to thermally isolate said second heating chamber.

13. The apparatus according to claim 11, wherein said carrier means comprises a plurality of hinged baskets spaced from each other, each having at least one compartment for a workpiece.

14. The apparatus according to claim 11, wherein said gate means are instantaneously opening and closing gates, and said conveyor means comprises a continuously advancing conveyor chain to which said baskets are hinged for them to be continuously conveyed through the heating and cooling chambers at a predetermined rate, and then upon reaching the gates, suddenly conveyed at a higher rate along a predetermined length.

15. The apparatus according to claim 11, wherein said moving conveyor means comprises an intermittently advancing conveyor chain to which said baskets are hinged to be intermittently conveyed along a predetermined length through said heating and cooling chambers.

16. The apparatus according to claim 11, wherein said heating and cooling chambers are a tunnel furnace wherein each said chamber is communicated and isolated from the other by said instantaneously opening and closing gates.

17. The apparatus according to claim 11, wherein said lifting means comprise a shaft mounted on a controllable fluid motor.

18. The apparatus according to claim 11, wherein said heating means are infrared heating means.

19. The apparatus according to claim 11, wherein said infrared heating means ar placed vertically at spaced sections on both sides of said heating chambers.

20. The apparatus according to claim 11, wherein said first thermal treatment temperature is in the range of about 500° C. to about 600° C.

21. The apparatus according to claim 11, wherein said second thermal treating temperature is in the range from about 50° C. to about 150° C.

22. The apparatus according to claim 11, wherein said third thermal treating temperature is in the range from about 150° C. to about 250° C.

* * * * *